United States Patent [19]

Sofy

[11] Patent Number: 4,513,602

[45] Date of Patent: Apr. 30, 1985

[54] TRANSFER DEVICE

[76] Inventor: Hugh M. Sofy, 201 Warrington, Bloomfield Hills, Mich. 48013

[21] Appl. No.: 432,080

[22] Filed: Sep. 30, 1982

[51] Int. Cl.[3] ..... B21J 13/08

[52] U.S. Cl. ..... 72/405; 198/621; 414/750; 72/421

[58] Field of Search ..... 72/405, 421; 198/621; 414/750

[56] References Cited

U.S. PATENT DOCUMENTS

| | | | |
|---|---|---|---|
| 2,929,485 | 3/1960 | Wallis | 198/621 |
| 3,025,731 | 3/1961 | Jacobs | 72/405 |
| 3,155,241 | 11/1964 | Suofy | 198/621 |
| 3,421,637 | 1/1969 | Sofy | 198/621 |
| 3,754,667 | 8/1973 | Storch | 72/405 |
| 3,805,582 | 4/1974 | Logan | 72/405 |
| 4,198,845 | 4/1980 | Sofy | 72/421 |

FOREIGN PATENT DOCUMENTS

| | | | |
|---|---|---|---|
| 108074 | 8/1979 | Japan | 198/621 |

*Primary Examiner*—Daniel C. Crane

*Attorney, Agent, or Firm*—Harness, Dickey & Pierce

[57] ABSTRACT

A transfer device for transferring workpieces progressively from station to station in a press by means of mechanical linkages actuated by the press ram. The linkages are uniquely configured and constructed to provide substantially unobstructed access to the stations. A clutch mechanism is provided that resiliently disconnects the linkages in the face of a predetermined resistance in order to prevent damage in the event of the jamming of a workpiece. At least one of the linkages is constructed as a unitized assembly for ease of installation. Brake means and lift and carry features may also be included in the transfer device.

8 Claims, 5 Drawing Figures

TRANSFER DEVICE

BACKGROUND OF THE INVENTION

The invention relates generally to transfer devices for moving workpieces progressively through a series of work stations in a machine. More particularly, the invention is an improved form of the transfer device of the type shown in U.S. Pat. No. 3,155,241, issued Nov. 3, 1964, U.S. Pat. No. 3,421,637, issued Jan. 14, 1967, and U.S. Pat. No. 4,198,845, issued Apr. 22, 1980.

As in the case of the earlier devices described in the above-mentioned patents, the disclosures of which are incorporated by reference herein, the transfer device of this invention is primarily adapted and preeminently suited for use with presses and the like. It operates basically in the same manner as such predecessor transfer devices but incorporates significant changes and modifications that permit it to operate at significantly higher speeds without excessive destructive vibrations. The invention further incorporates various features that make the device lighter and easier to install, as well as providing a more open construction which eliminates or minimizes obstructions of the work stations thus permitting greater utilization of the press area than was previously available.

SUMMARY OF THE INVENTION

The transfer device of this invention includes a first actuator means that moves a pair of elongate, opposed, work-holding jaw members or blades laterally back and forth in a generally horizontal plane. The jaw members are disposed on opposite sides of, and parallel to, a series of work stations and in operation are initially moved horizontally inwardly toward the work stations and into engagement with workpieces in the stations. Thereafter, the jaw members are indexed horizontally along the longitudinal line of work stations by second actuator means to simultaneously advance the workpieces one station in the series. After all of the workpieces have been advanced one station, the jaw members are moved apart by the first actuator means to disengage the workpieces and then retracted by the second actuator means to their starting positions. Both actuator means are in the form of mechanical linkages suitably interconnected through clutch means so that they are operated by the press ram to move the work-holding jaw members in the sequence of motions described above. Each of the transfer linkages includes a rock shaft that oscillates back and forth during operation of the actuator means, and the oscillatory motion of the rock shafts is transmitted to the work-holding jaw members through the clutch means and cam and cam follower means.

A significant part of the invention resides in the fact that the clutch means and the cam and cam follower means of the second actuator means are disposed laterally outward relative to the work stations and the fact that the rock shaft is disposed below the level of the work stations. Such a construction permits substantially unobstructed access to an end area of the press adjacent the work stations, thereby facilitating ease and convenience of unloading or loading the workpieces and allowing more efficient use of the press area. The overall mass and weight of the components of the first and second actuator means are also significantly reduced over prior work transfer devices. Furthermore, the clutch means in each actuator means includes improved means for a more positive return and retraction of the jaw assemblies. These and other features substantially improve the performance and enhance the utility of the work transfer mechanism as well as significantly increasing its operating speed.

Because of the clearances necessarily present in actuator linkages and related components of work transfer devices, the latter have a tendency to vibrate in use. These operational vibrations are not a problem if the press is operated at slow speeds in the order of 7 or 8 cycles per minute; however, if the press is operated substantially faster, the vibrations become significant and at times even destructive. Such objectionable and destructive vibrations may be obviated by a brake mechanism attached to, and cooperative with, the rock shaft of one or both of the actuator linkages. Such a brake mechanism is preferably included in the present invention and is disclosed in the above-mentioned U.S. Pat. No. 4,198,845. When the brake mechanism is installed in one or more particular locations in the transfer device, the press can be operated satisfactorily at speeds up to several times the speed at which it can be operated without the brake mechanism. As a consequence, the improved transfer device of this invention greatly increases and improves the production capacity of the press.

As suggested, the transfer device of this invention in its basic concept operates in a single horizontal plane. The jaws are first moved laterally inwardly toward each other to clamp or engage the workpieces, then advanced longitudinally to slide the workpieces simultaneously into adjacent stations, then moved laterally outwardly away from each other to disengage the workpieces, and finally retracted longitudinally to their initial or starting positions. However, it sometimes happens that, because of the shape of the workpiece or because of the nature of the forming operations performed in some or all of the stations, it is not convenient or even possible to simply slide the workpieces along from one station to the next. Rather, it is necessary to lift the workpieces out of the forming dies in one, several, or perhaps all, of the stations in order to transfer them to the next adjacent stations and the lower them onto the dies in these next stations. The work-engaging jaws thus may optionally be modified as required to incorporate lift and carry apparatus in all or selected stations. Such optional lifting and carrying apparatus is disclosed in the above-mentioned U.S. Pat. No. 4,198,845. If such apparatus is employed, the workpieces can be lifted out of the work stations and dropped into the adjacent stations as required by the shape of the workpieces and the particular forming operation. The lift and carry form of transfer can be incorporated in all of the stations or it can be used only in selected stations and combined with the straight-through transverse form of transfer in the remainder of the stations.

DETAILED DESCRIPTION OF THE PREFERRED EMBODIMENTS

Figure 1:
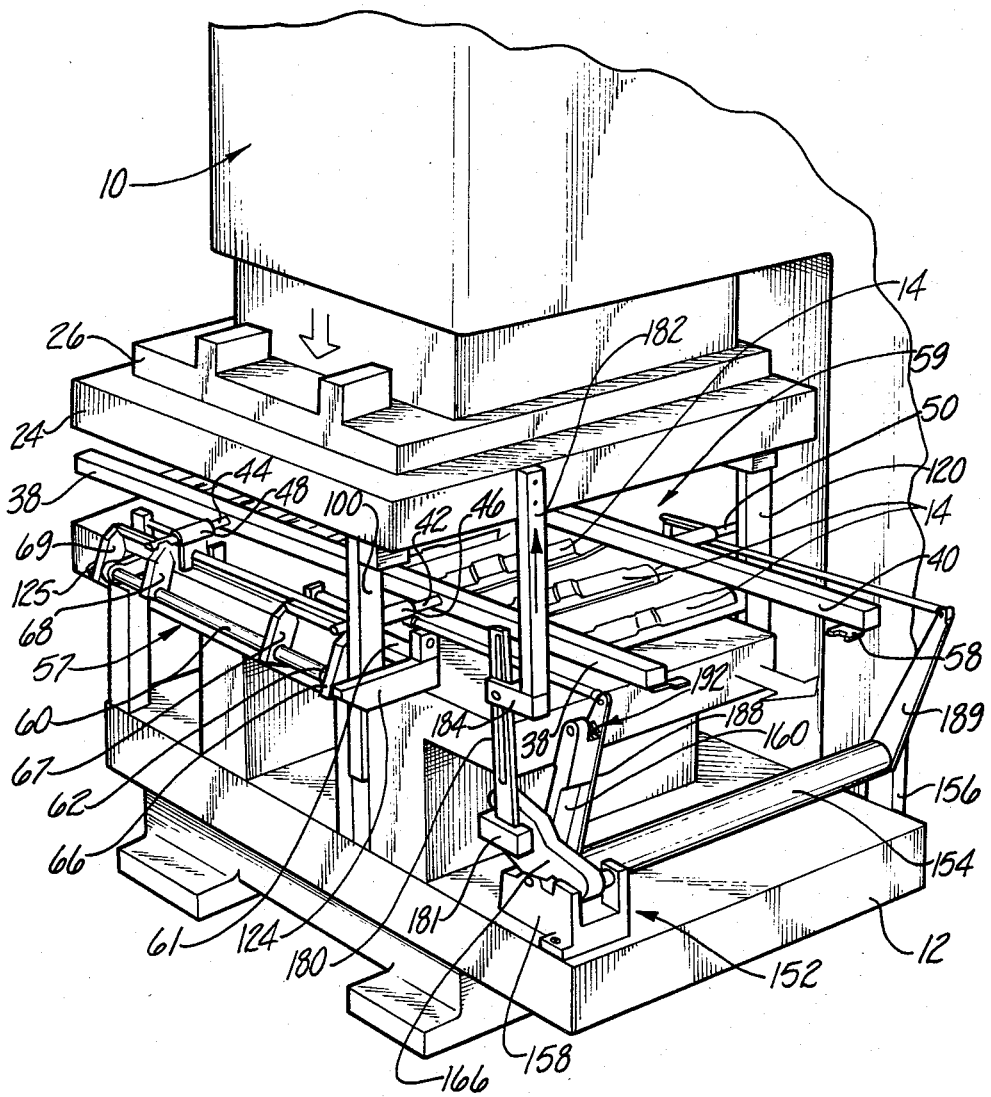
FIG. 1 is a fragmentary, perspective view of a conventional press showing the transfer device of this invention mounted therein.

FIGS. 1 through 4 of the drawings depict an exemplary embodiment of the invention for purposes of illustration only. One skilled in the art will readily recognize from the following description that the principles of the invention are also applicable to transfer devices other than that shown in the drawings.

Figures 2, 2A:
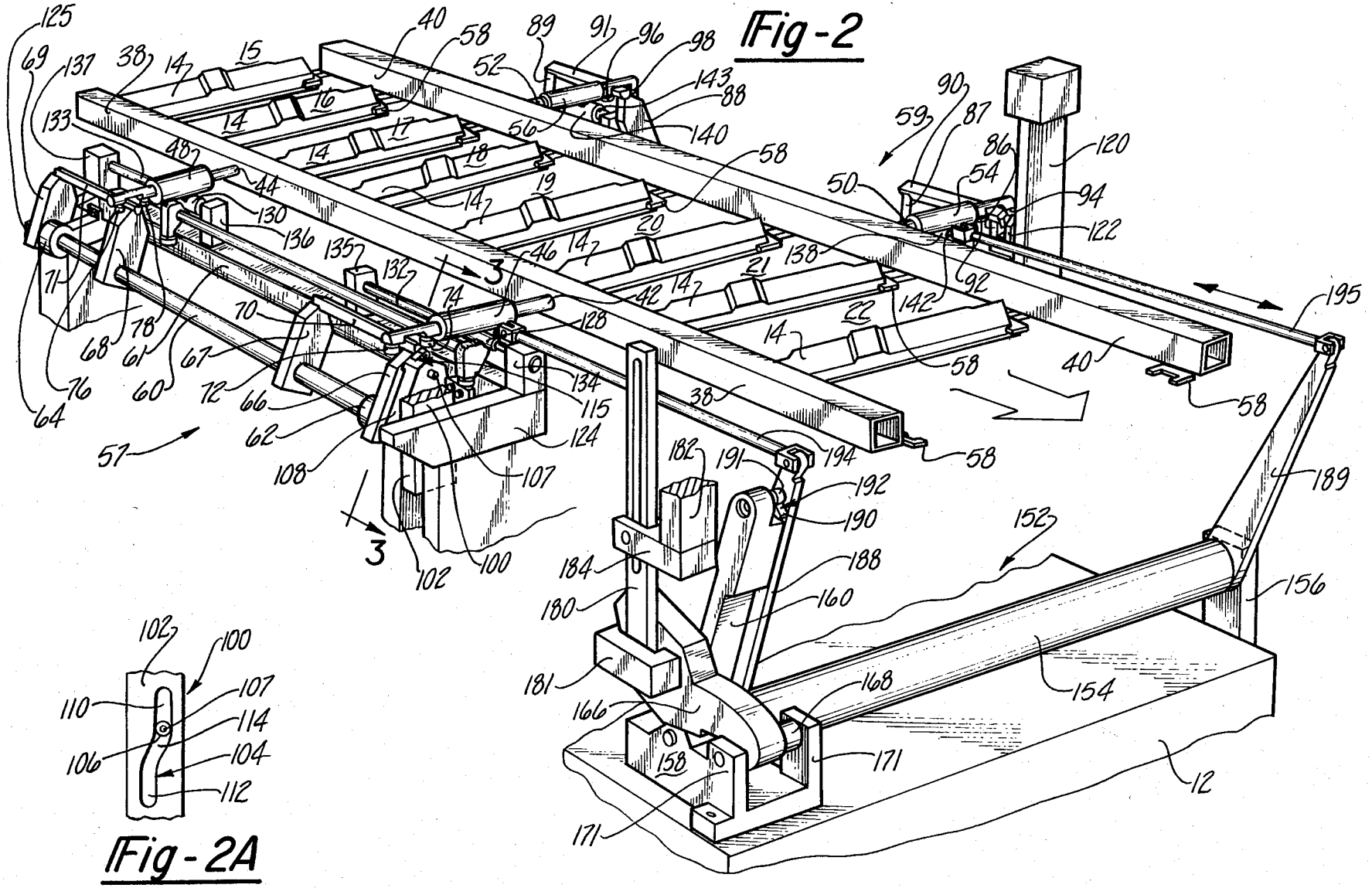
FIG. 2 is an enlarged perspective view of the transfer device, per se.
FIG. 2A is a partial elevational view showing an opposite surface of one of the cam bars and its associated cam follower roller that actuate part of the transfer mechanism to engage and disengage the work.

Referring to FIGS. 1 and 2, the reference numeral 10 designates a standard punch press having a die shoe 12 which supports a plurality of lower die members (not shown) in a series of stations represented generally by the reference numerals 15, 16, 17, 18, 19, 20, 21 and 22. A number of workpieces 14 are formed by the die members in conjunction with upper die members (not shown), which are carried by a punch shoe 24 driven in the conventional manner by a power ram 26. The punch shoe 24 is moved downwardly under power by the ram 26 to perform forming operations on the workpieces 14 in the plurality of equispaced stations 15 through 22, and after the forming operation is completed the punch shoe is retracted by the ram 26.

In the particular press 10, the workpieces 14 are shown merely by way of illustration in FIGS. 1 and 2. A workpiece 14 is first placed in the loading station 15 manually or by suitable automatic means, and a forming operation is performed thereon in the first work station 16. Subsequent forming operations are performed on the workpieces in work stations 16 through 21, and the finished workpiece 14 may be removed from the unloading station 22 either manually or by suitable automatic means.

The transfer device of this invention is mounted on the die shoe 12 at opposite sides and at one end of the series of work stations 15 through 22 and is operatively connected to the ram 26 to simultaneously advance all of the workpieces 14 one station in the press 10 each time it cycles. More particularly, in operation the transfer device moves elongated jaw members or blades 38 and 40, which are disposed at opposite sides of the work stations 15 through 22, first into clamping engagement with the workpieces 14. The jaw members 38 and 40 then advance the workpieces longitudinally one station in the press as the ram 26 is raised or retracted. As the ram is moved downwardly to bring the dies together in the forming operation, the transfer device separates the jaws 38 and 40 laterally to release the workpieces and then retracts the jaws to the initial or starting position.

For a more detailed description of the transfer mechanism, attention is first directed to FIG. 2, which shows that the jaw 38 is carried by a pair of spaced parallel rods 42 and 44 that extend laterally away from the jaw 38 and are mounted for reciprocation in elongated bearings 46 and 48, respectively. The jaw 40 is similarly carried by a pair of rods 50 and 52 that slidably operate in elongated bearings 54 and 56, respectively. The two jaws 38 and 40 extend substantially the full longitudinal length of the work stations 15 through 22 and include a number of work-engaging members 58. The work-engaging members 58 are spaced to receive, and are shaped to conform to, the edges of the workpieces 14 in the various stations. The jaws 38 and 40 are disposed on opposite sides of the series of work stations 15 through 22, and the work-engaging members 58 are spaced the same distance apart as the work stations so that each work-engaging member fits and clampingly engages an edge of the workpiece in the station with which it is associated when the jaw-carrying rods 42, 44 and 50, 52 are advanced laterally inwardly in the bearings 46, 48 and 54, 56, respectively. In practice, the jaws 38 and 40 are moved toward each other to clampingly engage opposite sides of the workpieces 14 at the beginning of the transfer operation, and the jaws are retracted and moved apart to disengage the workpieces after the latter have been advanced one work station by means described in detail below. The jaws 38 and 40 are moved into and out of clamping engagement with the workpieces 14 by actuator means, designated generally by reference numerals 57 and 59, which are disposed at the outer ends of the rods 42, 44 and 50, 56, respectively.

More particularly, the actuator means 57 associated with the jaw 38 comprises a horizontal rock shaft 60 disposed generally parallel to, and spaced laterally substantially from, one side of the stations 15 through 22. The shaft 60 is mounted for oscillatory movement in spaced bearing members 62 and 64 fixedly mounted on risers on the die shoe 12. The bearing members 62 and 64 at opposite ends of the rock shaft 60 also extend inwardly toward the work stations where they are fixed to a longitudinal frame member 61 (see FIG. 3) extending generally parallel to the rock shaft 60 and the jaw 38. Thus the actuator means 57 and, the actuator means 59 (described below) are each constructed as individual, unitized actuator assemblies having a frame structure upon which the various associated actuator components may be assembled so that each side of the press 10 may be installed in the press essentially as a unit. The frame structure of the actuator means 57 is formed primarily by the rock shaft 60 and the frame member 61, extending generally parallel to each other at the sides, and by the generally parallel bearing members 62 and 64 at opposite ends of the actuator assembly.

Two pairs of upstanding rocker arms 66, 67 and 68, 69 are fixed to opposite ends of the rock shaft 60, and the pairs of rocker arms carry separate cross bars 70, 71, respectively. Spaced rollers 72 and 74 on the laterally outer portion of the rod 42 embrace and closely receive the cross bar 70. Similarly, spaced rollers 76 and 78 on the laterally outer portion of the rod 44 embrace and closely receive the bar 71. It should be noted that the cross bars 70 and 71 preferably have rounded or arcuate lateral surfaces in order to continuously maintain their proper engagement with the spaced rollers 72, 74 and 76, 78, respectively, during the rocking or pivoting motion of the rocker arms 66, 67 and 68, 69, described below.

When the rock shaft 60 turns in the bearings 62 and 64 in a clockwise direction as viewed in FIG. 2, it rocks or pivots the pairs of rocker arms 66, 67 and 68, 69 toward the work stations 15–22 and acts through the inner rollers 74 and 78 to slide the rods 42 and 44 inwardly in the bearings 46 and 48 to bring the jaw 38 into clamping engagement with the workpieces 14. Conversely, when the rock shaft 60 turns counterclockwise it acts through the outer rollers 72 and 76 to withdraw the jaw 38 in order to release the workpieces 14.

Similar means is provided on the other side of the transfer device for moving the jaw 40 (associated with the other actuator means 59) into and out of clamping engagement with the workpieces 14. A rock shaft (not shown) is disposed generally parallel to, and laterally from, the opposite side to the stations 15 through 22 and is mounted in an associated pair of spaced bearing members (not shown), which are supported on and fixed to risers on the die shoe 12. Like the bearing members 62 and 64 discussed above, these bearing members are also fixed to a longitudinal frame member (not shown) to form a frame structure with their associated rock shaft for the actuator means 59, thus allowing installation thereof as a unitized assembly on the press 10.

Upstanding pairs of rocker arms 86, 87, and 88, 89 are fixed to the rock shaft at opposite ends thereof, and the pairs of rocker arms are connected at their upper ends by separate cross bars 90 and 91, respectively. Spaced rollers 92 and 94 on the rod 50 embrace and snugly fit the cross bar 90, and correspondingly spaced rollers 96 and 98 on the rod 52 similarly embrace and closely receive the cross bar 91 so that oscillatory movement of the rock shaft acts through the rollers 92, 94 and 96, 98 to slide the rods 50 and 52 back and forth in the bearings 54 and 56, thereby moving the jaw 40 into and out of clamping engagement with the workpieces 14.

In practice, the rock shafts on opposite sides of the work stations are turned simultaneously by the two actuator means 57 and 59 at the beginning of the transfer operation to laterally advance the jaws 38 and 40 from opposite sides of the work stations 15 through 22 into clamping engagement with the workpieces 14. After the workpieces 14 have been advanced one work station in the press by second actuator means (described in detail below), the rock shafts are again operated simultaneously in opposite directions to laterally move the jaws 38 and 40 away from the work stations 15 through 22 and out of engagement with the workpieces 14.

Figure 3:
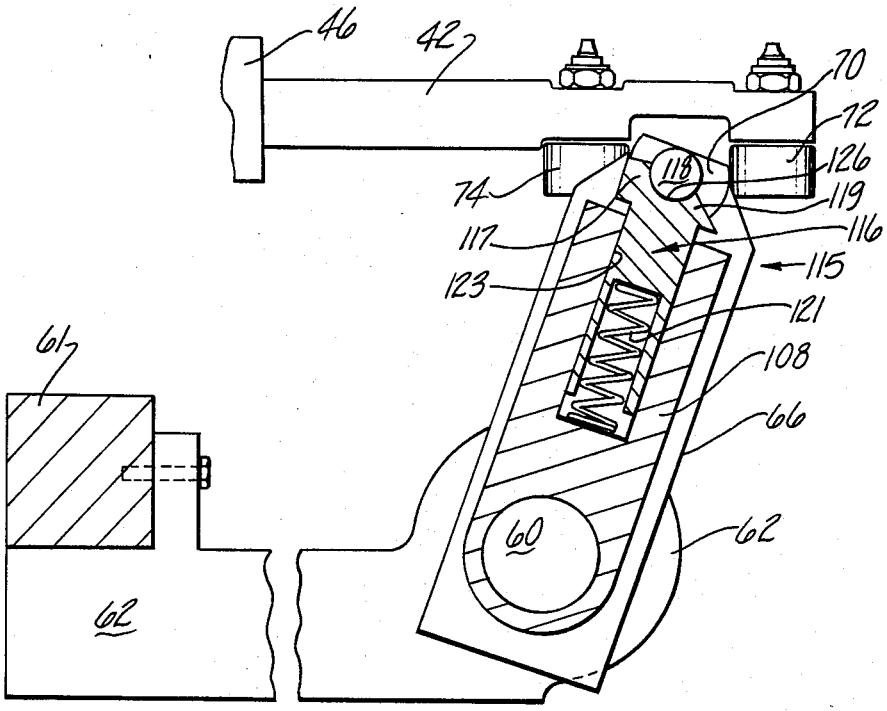
FIG. 3 is a cross-sectional view taken along line 3—3 of FIG. 2.

The means for oscillating the rock shaft 60 comprises a cam bar 100 attached to, and movable vertically with, the punch shoe 24 in a depending relationship therewith, as perhaps best shown in FIG. 1. Referring to FIGS. 2, 2A and 3, the cam bar 100 extends downwardly alongside, but is spaced laterally from, the rocker arm 66 and has a cam slot 104 opening through the opposite side 102 thereof for receiving a cam follower roller 106. The cam slot 104 and cam follower 106 are best shown in FIG. 2A, which is a partial view of the opposite face 102 of portion of the cam bar 100, broken away in FIG. 2 for purposes of clarity in illustrating the remainder of the device. The cam follower 106 is mounted for rotation on a pin 107 protruding laterally from a clutch arm 108 (FIG. 2). The clutch arm 108 is mounted loosely on the rock shaft 60 between the rocker arm 66 and the cam bar 100. The terminal portions 110 and 112 of the cam slot 104 are disposed vertically in the cam bar 100 but are offset laterally from each other and interconnected by an inclined slot portion 114. The upper terminal portion 110 is disposed adjacent to the outer edge (away from the work stations) of the cam bar 100, the intermediate portion 114 inclines downwardly and inwardly toward the work stations 15 through 22, and the lower terminal portion 112 is disposed adjacent the inner edge (toward the work stations) of the cam bar.

A clutch mechanism 115 (shown in FIG. 3) releasably interconnects the clutch arm 108 and the assembly consisting of the rocker arm 66 and the cross bar 70 for mutual operation with the rock shaft 60. More particularly, as shown in FIG. 3, a spring-loaded clutch element 116 yieldingly engages a pin 118 carried by, and projecting from the cross bar 70. The clutch element 116 is slidably mounted in a way 123 in the clutch arm 108, and a compression spring 121, which is confined between the bottom of the way and the clutch element 116, holds the latter normally in a raised or extended position. If desired, the upper and lower terminal portions of the spring 121 may be retained in sockets provided in the lower end of the clutch element 116 and the bottom of the way 123 to assist in retaining the clutch element in the way 123. The pin 118, which may optionally have a roller rotatably mounted thereon, if desired, normally seats in an arcuate recess 126 in the top of the clutch element 116 and is held firmly in pressed engagement with the clutch element by the compression spring 121. In practice, the spring 121 presses the clutch element 116 against the pin 118 with sufficient force to releasably join the clutch arm 108 and the rocker arm 66 for mutual operation with the rock shaft 50. However, in the event that an obstruction or a resistance of a predetermined magnitude is encountered in the indexing movement of the transfer device, the pin 118 slides or rolls out of its seat 126 against the resilient action of the spring 121 and disengages or disconnects the clutch arm 108 from the rocker arm 66 so that the portion of the mechanism actuated by the ram 26 is free to complete its motion without driving the transfer device in order to prevent damage to the latter.

While the clutch mechanism 115 only is shown in detail in the drawings, it will be readily appreciated that the clutch mechanism 192 to be discussed below is similar in construction and operation to the clutch mechanism 115.

When the ram 26 is at the lower limit of its lower stroke, i.e. in the fully "down" position, the cam follower 106 and pin 107 are at or adjacent the upper end of the cam slot 104. At this point, the upper terminal portion 110 of the slot 104 will be urged toward the outer side of the cam bar 100, the rock shaft 60 will be at the limit of its counterclockwise (as viewed in FIG. 2) oscillatory movement, and the jaw 38 associated therewith will be laterally pulled back away from, and out of engagement with, the workpieces 14. As the ram 26 retracts or moves upwardly in the press 10, it pulls the cam bar 100 upwardly with it and the cam follower 106 moves downwardly in the cam slot 104.

During the initial retractive movement of the ram 26 when the upper dies carried by the punch shoe 24 are moving away from and clearing the workpieces 14 in the stations 15 through 22, the cam roller 106 simply traverses the straight upper terminal portion 110 of the cam slot 104 without effect insofar as the transfer device is concerned. However, after the initial retractive movement of the ram 26, the cam roller 106 enters the inclined intermediate portion 114 of the cam slot 104 and, as the cam roller 106 traverses the slot portion 114, it moves to the right or toward the stations 15 through 22 and acts through the clutch arm 108 and the rocker arm 66 to turn the rock shaft 60 clockwise (as viewed in FIG. 2). This in turn swings the cross bars 70 and 71 in the direction of the stations 15 through 22 and laterally advances the rods 42 and 44 in the manner hereinabove described to move the jaw 38 into clamping engagement with adjacent edges of the workpieces 14.

As discussed above, the clutch element 116 of the clutch mechanism 115 is spring-pressed by the spring 121 against the pin 118 with sufficient force so that the clutch arm 108, the rocker arm 66, and the cross bar 70 always move together, drivingly connected in unison to slidably actuate the associated jaw assembly except in case of a jam such as might occur if one of the workpieces becomes displaced from its work station during inward movement of the jaw members toward the work stations. In this latter event, the spring 121 compresses and allows the clutch element 116 to release the pin 118 in response to a predetermined resistance to permit the ram 26 to complete its movement without effect on the transfer device, thereby preventing damage to the transfer device in the normal operation of the equipment. It should be noted that the inner shoulder 117 on the inner side of the clutch element 116 is larger than the outer shoulder 119 and thus circumscribes a larger portion of the pin 118 than does the outer shoulder 119. Such larger inner shoulder 117 substantially prevents the pin 118 from being drivingly disconnected from the clutch element 115 and provides a more positive engagement with the pin 118 on the cross bar 70 and thereby provides for a more positive retraction or retention of the rod 42 and the jaw 38. The larger shoulder may be provided on the inner shoulder of the clutch element 116 because the above-mentioned jamming of a workpiece is most likely to occur as the jaws are moving toward the work stations but very infrequently occurs as the jaws are being retracted away from the work stations.

Conversely, the cam roller 106 is disposed at or near the bottom of the lower slot portion 112 when the ram 26 is at the upper limit of its travel in the press 10. Thus, when the ram moves downwardly on its power stroke, the cam roller 106 traverses the cam slot 104 to perform the operations described above in reverse order with the result that the rock shaft 60 is turned counterclockwise to laterally withdraw the jaw blade 38 from the work stations 15–22 and to disengage the blade from the workpieces 14.

The portion of the transfer device associated with the jaw 40 at the opposite side of the work stations 15 through 22 is similarly actuated to move the jaw 40 either into or out of clamping engagement with the workpieces 14. Inasmuch as the two actuator means 57 and 59 are similar in operation and in their frame structure and assembly-type construction, a detailed description of the mechanism for actuating the jaw 40 is not necessary for a complete understanding of the construction and operation of the transfer device as a whole. Suffice it to say that a cam bar 120 similar to the cam bar 100 is attached to and actuated by the ram 26 adjacent to the right rear corner thereof as viewed in FIGS. 1 and 2. The cam bar 120 has a cam slot (not shown) similar to the cam slot 104, and a cam roller (not shown) on a clutch arm 122 loosely mounted on the associated rock shaft (not shown) moves in the cam slot to oscillate the rock shaft and the pairs of rocker arms 86, 87 and 88, 89 to swing the cross bars 90 and 91, respectively, and to slidably actuate the rods 50 and 52 associated therewith to move the jaw blade 40 toward or from the line of stations 15 through 22. The clutch arm 122 similarly is detachably drivingly connected to its rocker arm for mutual operation therewith by a clutch mechanism similar to the clutch mechanisms 115 discussed above. More particularly, the clutch arm 122 carries a spring-loaded clutch element (not shown) that normally seats against and retains a pin projecting from the cross bar 90, similar to the arrangement discussed above for the actuator means 57, so that lateral movement of the clutch arm by the cam and cam follower means causes the rocker arms to move in unison therewith and to reciprocally actuate the jaw assembly in the manner described above.

The workpieces 14 are longitudinally indexed progressively from station to station in the press 10 by moving the jaws 38, and 40 parallel to the line of stations 15 through 22 a distance equal to the spacing between adjacent stations while the jaws are advanced and in clamping engagement with the workpieces. To this end, the two bearings 46 and 48 are mounted on, and fixed to, transverse bearings 128 and 130 that are in turn mounted for reciprocation on bearing shafts 132 and 133, respectively, fixed to 134, 135 and 136, 137, which are fixed to the longitudinal frame member 61. The end plates 124 and 125 are in turn fixed to risers on the die shoe 12. Similarly, the bearings 54 and 56 are fixed to transverse bearings 138 and 140 that are carried by bearing shafts 142, 143 fixedly mounted at each end or blocks (not shown) fixed to end plates (not shown). Such end plates are also fixed to risers on the die shoe 12.

Figure 4:
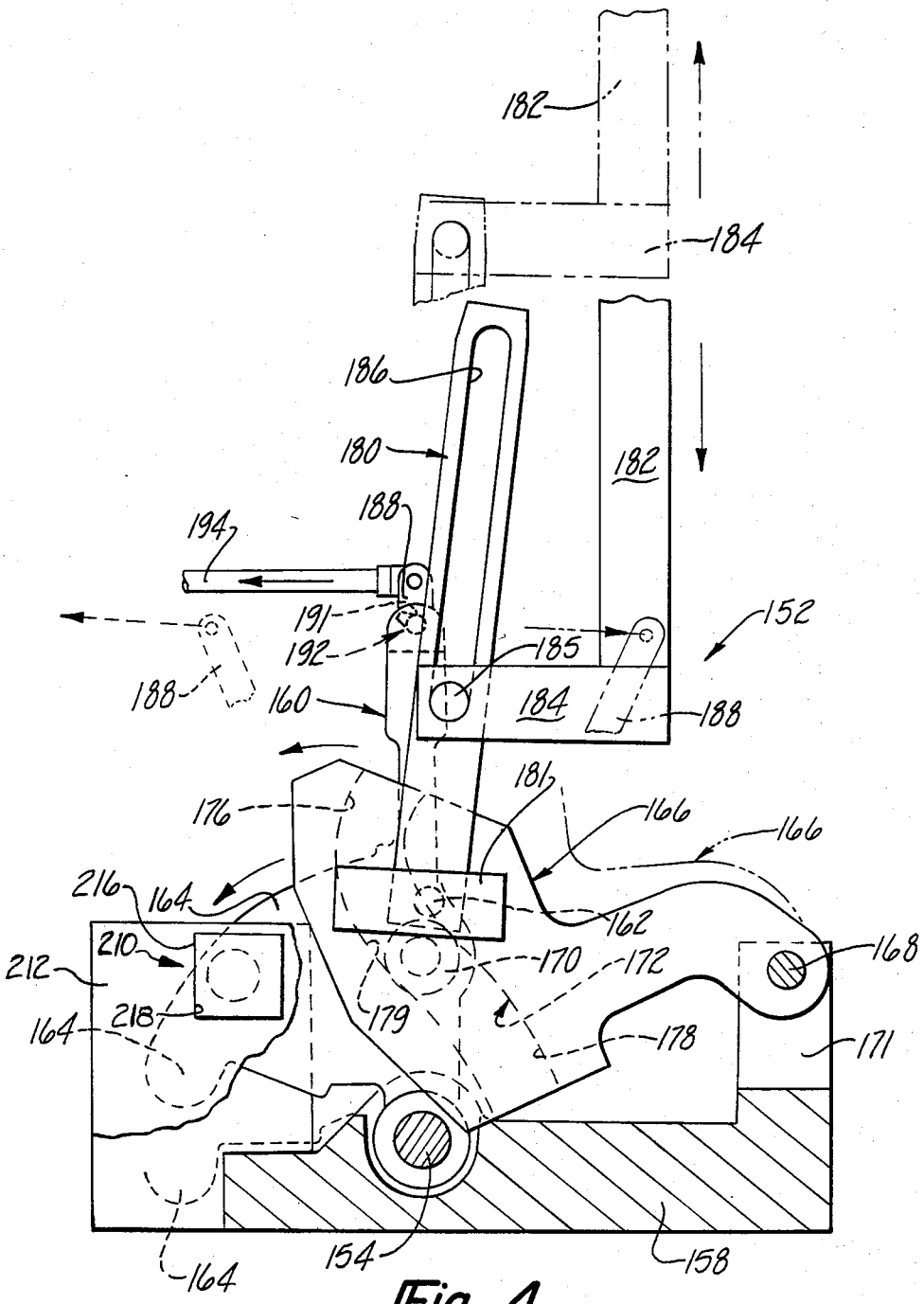
FIG. 4 is an enlarged, fragmentary, perspective view showing a portion of the linkage mechanism that advances the workpieces in the press.

Referring to FIGS. 2 and 4, an actuator means 152 for indexing the workpieces 14 from station to station comprises a rock shaft 154 rotatably supported by spaced bearings in a bearing block 156 and a frame member 158, both of which are supported on, and fixed to, the die shoe 12 at one end of the work stations 15 through 22. A clutch arm 160 is loosely mounted on the rock shaft 154 for rotation thereon and includes a cam follower 170 projecting laterally therefrom and a brake paddle portion 164, the purpose of which is explained below in connection with the above-mentioned brake mechanism. A pivot cam member 166 is pivotally mounted on a shaft 168 supported by upstanding portions 171 of the frame member 158. A generally vertical cam slot 172 in the cam member 166 receives a cam follower roller 170 pivotally mounted on, and disposed laterally of, a pin projecting from the clutch arm 160. As perhaps best shown in FIG. 4, the cam slot 172 has arcuate upper and lower terminal portions 176 an 178 which are offset with respect to each other and interconnected by an intermediate inflection portion 179.

It will be observed that the actuator means 152 is disposed generally at the right end of the stations 15 through 22, as viewed in FIGS. 1 and 2, and that the upper terminal portion 176 of the cam slot 172 is disposed generally to the left of the lower terminal portion 178. Thus, upward pivotal movement of the pivot cam member 166 causes the cam follower 170, as it traverses the inclined intermediate portion 179 of the cam slot 172, to pivot or swing the clutch arm 160 in a clockwise direction as viewed in FIG. 2. Conversely, downward movement of the pivot cam member 166 acts through the cam follower 170 as it traverses the intermediate portion 179 of the cam slot 172 to pivot or swing the clutch arm 160 counterclockwise, as is shown in FIG. 4 for purposes of illustration.

The pivot cam member 166 is actuated by the ram 26 through a drive link 180, an actuator bar 182 depending downwardly from the punch shoe 24 (FIG. 1), and a striker block 184 extending longitudinally from the actuator bar. The striker block 184 straddles the drive link 180 and includes a pin 185 extending through a vertically elongated opening 186 formed in the drive link 180, which is pivotally attached to the cam member 166 by way of pivot means 181. The striker block 184 is disposed at the lower end of the opening 186 when the ram 26 is at the lower limit of its travel in the press 10.

Thus, during initial upward movement of the ram 26, the striker block 184 moves to the top of the opening 186 without effect insofar as operation of the actuator means 152 is concerned. Thereafter, continued upward movement of the ram 26 acts through the striker block 184 to lift the drive link 180 and to pivot the cam member 166 upwardly. As the cam member 166 moves upwardly, the cam follower 170 moves downwardly in the cam slot 172 to pivot or swing the clutch arm 160 clockwise in the manner described above. Conversely, when the ram 26 moves downwardly on its power stroke the initial movement is without effect on the actuator means 152 since the striker block 184 simply traverses the opening 186 in the drive link 180. However, when the striker block 184 reaches the lower end of the opening 186, it moves the drive link 180 and acts through the pivot pin 162 downwardly to cause the cam member 166 to rock downwardly on its pivot 168, thereby causing the cam follower 170 to move upwardly relative to the cam slot 172 so as to pivot or swing the clutch arm 160 counterclockwise.

Oscillatory movement of the clutch arm 160 on the rock shaft 154 is transmitted to a pair of actuating levers 188 and 189 fixed to opposite ends of the rock shaft 154 through a clutch mechanism designated generally by the reference numeral 192 at the upper end of the clutch arm 160. The actuating levers 188 and 189 are pivotally attached to a pair of bars 194 and 195, respectively, which are in turn pivotally attached to the elongate bearings 46 and 54, respectively. Thus, since the elongate bearings 46 and 54 are fixedly attached to the bearings 128 and 138, longitudinal movement of the bars 194 and 195 causes the jaws 38 and 40 to move longitudinally.

The clutch mechanism 192 includes a clutch element 190 spring-biased outwardly from an opening or way 123 in the clutch arm 160 to releasably engage a pin 191 secured to the associated actuating lever 188. The clutch mechanism operates in the same way as the clutch mechanism 115 described above in connection with the jaw actuator means 57 and 59 so that upward movement of the drive link 180 acts through the pivot cam member 166 and the clutch arm 160 to cause clockwise pivotal movement of the clutch mechanism 192 and the actuating levers 188 and 189, thereby causing the bars 194 and 195 to longitudinally move the jaws 38 and 40 bodily to the right, as viewed in FIGS. 1 and 2. In practice, this motion is performed when the jaws 38 and 40 are in clamping engagement with the workpieces 14, and the cam slot 172 which generates the motion is configured and dimensioned so that the jaws and the workpieces are moved a distance equal to the spacing between adjacent stations 15 through 22. Thus, full oscillatory movement of the rock shaft 154 causes all of the workpieces 14 to advance one station in the press 10. Conversely, downward movement of the drive link 180 acts through the same linkage mechanism referred to specifically above to longitudinally move the jaws 38 and 40 the same distance to the left, as viewed in the drawings. In practice, this latter movement is performed when the jaws are retracted and disengaged from the workpieces 14.

It should be noted that the outer shoulder of the clutch element 190 (viz., the shoulder oriented away from the actuator assembly 57) is preferably larger than the inner shoulder. Like the larger inner shoulder 117 on the clutch element 116 described in detail above, such larger outer shoulder on the clutch element 190 provides a more positive engagement with the pin on the actuating lever 188 and thus provides for a more positive retraction of the jaw actuating assemblies in a direction to the left, as viewed in FIGS. 1 and 2. Such larger shoulder may be provided on the outer side of the clutch element 190 because any jamming of the workpieces is most likely to occur as they are being indexed to the next work station but occurs very infrequently when the jaw actuating assemblies are being retracted after the workpiece indexing has already occurred.

The actuator means 152 for indexing the workpieces 14 from one station to the next has nearly all of its linkage mechanism components disposed laterally outward relative to the remainder of the work transfer device, with the only exception being the rock shaft 154. Thus, since even the rock shaft 154 is disposed in a vertical position below the level of the workpieces, the press area may be more efficiently used, and the end area of the press are substantially unobstructed to allow space for convenient loading or unloading of the workpieces either manually or by automatic means. Furthermore, the work transfer device of the present invention is considerably lighter in weight than either its predecessors or the typical previously known work transfer devices of the general type described herein. Thus the ease and convenience of loading or unloading of the workpieces and the reduced weight combine to permit the work transfer device according to the invention to operate at higher speeds that are approximately 26% higher than it predecessors, for example.

It should be noted that the construction and configuration of the actuator means 152 is described herein as adapted for rightwardly longitudinal movement (as viewed in FIGS. 1 and 2) to effectively "pull" the workpieces longitudinally from left to right in order to index them from station to station. However, as will be readily recognized by one skilled in the art, the actuator means may if desired be mounted at the opposite end of the press from that shown in the drawings, and the bars 194 and 195 may be oriented to project rightwardly from the actuating levers 188 and 189, in order to allow the actuator means 152 to "push" the workpieces longitudinally from left to right during the indexing portion of the operation cycle. Alternatively, the actuator means 152 may be retained in the location shown in the drawings, but rotated 180° with the bars 194 and 195 reversed in order to longitudinally index the workpieces from right to left, if desired. These and other variations readily apparent to those skilled in the art may be used to take full advantage of the efficiency, improved performance, and versatility of the present invention. It should be noted that the actuator means 152 of the above-mentioned U.S. Pat. No. 4,198,845 may alternatively be substituted for the actuator means 152 herein.

As previously suggested, the press 10 can be operated at significantly higher speeds without objectionable and destructive vibration during the transfer operation in the various linkages that actuate the jaws 38 and 40 if a brake mechanism is included in one or more of the linkages. It is most important that a brake mechanism be incorporated in the longitudinal indexing actuator means 152 since this particular actuator is required to move the jaw assemblies and the parts associated therewith the greatest distance; furthermore, movement of the greatest amount of mass and weight is involved in the indexing movement of the jaw and jaw actuating assemblies and the workpieces 14. On the other hand, the linkage mechanisms 57 and 59 that laterally move the jaws into and out of clamping engagement with the workpieces 14 are required to move only a comparatively short distance, and the mass or weight of the moving parts is considerably less. Thus, a brake mechanism is preferably incorporated in the indexing actuator means 152 only; it is to be understood that if necessary or desirable a similar brake mechanism can be incorporated in the actuator means 57 and 59.

More particularly, the brake mechanism 210 in FIG. 4 extends laterally inwardly from the frame member 158 to operably engage the longitudinally extending brake paddle portion 164 of the clutch arm 160 which is spaced slightly away from the support member. An elongated brake housing 216 of a generally square cross-section is slidably mounted in a correspondingly-shaped opening 218 in the support 212. The brake paddle portion 164 overlaps a portion of the opening 218, and the brake housing 216 is formed with a recess (not shown) that accepts the overlapping portion of the brake paddle. Further, such recess is at least slightly wider than the brake paddle so that the latter is free to oscillate with the clutch arm 160 without direct interference from the housing 216. However, oscillatory movement of the brake paddle portion 164 is braked and dampened by brake shoes (not shown) disposed on opposite sides of the recess in the housing 216. The shoes bear against opposite sides of the brake paddle portion 164 under action of a compression spring (not shown) disposed in the housing 216.

In operation, the brake housing 216 is free to slide back and forth in the opening 218 to accommodate any irregularities in the brake paddle portion 164, and the compression spring holds the brake shoes 222 and 224 at all times firmly in engagement with the brake paddle portion as it oscillates with the clutch arm 160. Pressure exerted against the brake paddle portion 164 by the brake shoes takes up play or lost motion between the interconnected relatively movable parts of the actuator means 152, and particularly the interaction between the brake shoes and the brake paddle portion keeps the cam follower 170 in pressed engagement with one side or the other of the cam slot 172 during both upward and downward pivotal movement of the cam member 166. The brake mechanism will permit the press 10 to cycle significantly faster without objectionable and destructive vibration of the transfer device. In relatively large and heavy transfer devices, it is deemed desirable to incorporate the brake mechanism 210 in all of the actuator means 57, 59 and 152, but in relatively light transfer devices a single brake mechanism associated with the linkage mechanism 152 only is felt to be adequate. For a detailed description and drawings of the brake mechanism 210, reference should be made to the above-mentioned U.S. Pat. No. 4,198,845, the entire disclosure of which is incorporated by reference herein.

The following is a brief description of the operation of the press 10 and of the transfer device of this invention associated therewith. In FIG. 1, the transfer device is shown in a fully closed press position and the cycle is complete. The operation of the transfer device begins when the ram 26 is withdrawn in an upward direction. This action also moves the cam bars 100 and 120 and the striker block 184, which are all attached to the punch shoe 24, in an upward direction. However, this initial movement causes no movement of the transfer device due to the dwell areas provided by the upper cam slot portions 110 of the cam slot 104 and the opening 186 in the drive link 180 of actuator means 152. The first movement of the transfer action begins when the camming surfaces of the intermediate cam slot portions 114 in the two first actuator means 57 and 59 contact the cam followers attached to clutch arms 108 and 122 to force the cross bars 70, 71 and 90, 91 inwardly toward the stations 15 through 22 thus urging the jaws 38 and 40 into clamping engagement with the workpieces 14. The forward indexing action occurs after the striker block 184 has traveled through the dwell area provided by the opening 186 in the drive link 180. The striker block 184 does not reach the end of the opening 186 and begin to lift the drive link until after the jaws 38 and 40 have clamped the workpieces 14. However, as soon as the drive link 180 begins to rise, the cam slot 172 in the cam member 166 forces the cam follower 170 to the right as viewed in FIG. 2 to swing or pivot the clutch arm 160 and the actuating levers 188 and 189 in the same rightward or clockwise direction. As the clutch arm and actuating levers turn clockwise in the manner described, they drive the bars 194 and 195 also to the right to index the jaw and jaw actuating assemblies, thus moving each of the workpieces 14 clamped thereby one station in the press 10.

The brake mechanism 210 described above is a means of keeping the cam follower roller 170 against the cam slot 172 and of preventing movement between other interconnected and relatively movable parts of the actuator linkage which causes shaking and vibration of the mechanism in use. The float of the brake housing 216 insures constant pressure of the brake shoes against the brake paddle portion 164 at all times. The forward transfer of the workpieces is completed on the final portion of the up-stroke of the ram 26.

As the ram 26 begins to move downwardly in the press 10 after a stamping or other operation on the workpieces is completed, the action of the transfer device is reversed. Cam bars 100 and 120 force jaw assemblies apart and disengage the jaws 38 and 40 from the workpieces 14. The drive link 180 is forced downwardly, moving the cam follower 170 to the left (as shown in FIG. 2) and returning the bars 194 and 195 and the jaw assemblies to their original or starting positions.

As previously indicated, the lift and carry mechanism illustrated in FIGS. 6 and 7 of the above-mentioned U.S. Pat. No. 4,198,845 can be readily incorporated in the transfer device, if desired, as a special feature. The entire disclosure of said patent is therefore incorporated herein by reference and thus may be consulted for the details of the operation and construction of the lift and carry mechanism.

The foregoing discussion discloses and describes merely exemplary embodiments of the present invention. One skilled in the art will readily recognize from such discussion that various changes, modifications and variations may be made therein without departing from the spirit and scope of the invention as defined in the following claims.

What is claimed is:

1. A work transfer device for moving a plurality of workpieces progressively from station to station in a generally longitudinal direction in a press of the type having a reciprocable part and a series of in-line work stations in which operations are performed on said workpieces, said transfer device comprising work-holding jaw means disposed laterally in opposed relation on opposite sides of said stations; and first and second actuator means operatively connected to and actuated by said reciprocable part of said press, said first actuator means being adapted to reciprocatingly actuate said jaw means toward and away from each other in generally lateral directions transversely of said work stations into and out of clamping engagement with workpieces therein, said second actuator means adapted to longitudinally and reciprocatingly actuate said jaw means while said jaw means are clampingly engaged with said workpieces in order to longitudinally index said workpieces simultaneously to the next adjacent stations, said second actuator means having a rock shaft drivingly interconnected with said jaw means, cam and cam follower means drivingly connecting said reciprocable part of said press to a second actuator clutch assembly, said clutch assembly drivingly connecting said cam and cam follower means to said rock shaft, said second actuator clutch assembly including resiliently yieldable means for drivingly disconnecting said cam and cam follower means from said rock shaft in response to a first predetermined level of resistance to the longitudinal movement of said jaw means while said jaw means are clampingly engaged with said workpieces, thereby substantially preventing damage to said work transfer device in the event of the jamming of a workpiece therein, said resiliently yieldable means drivingly disconnecting said cam and cam follower means from said rock shaft in response to a second predetermined level of resistance to the longitudinal movement of said jaw means while said jaw means are clampingly disengaged from said workpieces, said second predetermined level being greater than said first predetermined level of resistance, said second actuator clutch assembly and said cam and cam follower means being disposed laterally outward relative to said work stations and said rock shaft being vertically disposed below the level of said work stations, thereby permitting substantially unobstructed access to said work stations from an end area of said press.

2. A work transfer device according to claim 1, wherein said first actuator means includes separate and independent frame means on each lateral side of said work stations for permitting said first actuator means to be installed in said press as a unitized assembly with its associated jaw means, each of said frame means further being independent and separate from said second actuator means but being selectively connectable and disconnectable thereto in order to operatively cooperate therewith in order to longitudinally move said jaw means.

3. A work transfer device according to claim 1, wherein said first actuator means includes a first actuator clutch assembly for drivingly connecting said reciprocatable part of said press to said jaw means in order to laterally and reciprocatingly actuate said jaw means, said first actuator clutch assembly including means for disconnecting said reciprocable part of said press from said jaw means in response to a third predetermined level of resistance to lateral movement of said jaw means, thereby substantially preventing damage to said work transfer device in the event of the jamming of a workpiece therein.

4. A work transfer device according to claim 3, wherein said disconnecting of said reciprocable part of said press occurs in response to said third predetermined level of resistance to lateral movement of said jaw means while said jaw means are being moved laterally inwardly to clampingly engage said workpieces.

5. A work transfer device according to claim 4, wherein said first actuator clutch assembly further includes means for disconnecting said reciprocable part of said press from said jaw means in response to a fourth predetermined level of resistance to lateral movement of said jaw means when said jaw means are being moved laterally outwardly by said first actuator means to clampingly disengage said workpiece, said fourth predetermined level being greater than said third predetermined level of resistance.

6. A work transfer device according to claim 4, wherein first actuator means includes separate and independent frame means on each lateral side of said work stations for permitting said first actuator means to be installed in said press as a unitized assembly with its associated jaw means, each of said frame means further being independent and separate from said second actuator means but being selectively connectable and disconnectable thereto in order to operatively coooperate therewith in order to longitudinally move said jaw means.

7. The work transfer device according to claim 1, wherein said second predetermined level of resistance is sufficiently greater than said first predetermined level as to substantially prevent said disconnecting of said cam and said cam follower means from said rock shaft when said jaw means are being moved by said second actuator while said jaw means are clampingly disengaged from said workpieces.

8. The work transfer device according to claim 5, wherein said fourth predetermined level of resistance is sufficiently greater than said third predetermined level as to substantially prevent said disconnecting of said reciprocable part of said press from said jaw means when said jaw means are being moved laterally outwardly by said first actuator means to clampingly disengage said workpiece.

* * * * *